US006456692B1

(12) United States Patent
Smith

(10) Patent No.: US 6,456,692 B1
(45) Date of Patent: Sep. 24, 2002

(54) HIGH EMISSIVE COATINGS ON X-RAY TUBE COMPONENTS

(75) Inventor: Ricky B. Smith, Sandy, UT (US)

(73) Assignee: Varian Medical Systems, Inc., Palo Alto, CA (US)

( * ) Notice: Subject to any disclaimer, the term of this patent is extended or adjusted under 35 U.S.C. 154(b) by 0 days.

(21) Appl. No.: 09/672,627

(22) Filed: Sep. 28, 2000

(51) Int. Cl.[7] ..... H01J 35/10

(52) U.S. Cl. ..... 378/129; 378/131; 378/132; 310/90

(58) Field of Search ..... 378/119, 121, 378/125, 127, 129, 131, 141, 132; 310/90

(56) References Cited

U.S. PATENT DOCUMENTS 3,993,923 A * 11/1976 Magendans et al. ..... 313/330
4,516,255 A * 5/1985 Petter et al. ..... 378/143
4,943,989 A * 7/1990 Lounsberry et al. ..... 378/130
5,157,705 A * 10/1992 Hohenauer ..... 378/143
5,461,659 A * 10/1995 Siemers et al. ..... 378/129
5,520,996 A * 5/1996 Balian et al. ..... 428/216
5,553,114 A * 9/1996 Siemers et al. ..... 378/129
5,837,361 A * 11/1998 Glaser et al. ..... 428/216
6,144,720 A 11/2000 DeCou et al. ..... 378/131

* cited by examiner

*Primary Examiner*—Robert H. Kim
*Assistant Examiner*—Jurie Yun
(74) *Attorney, Agent, or Firm*—Workman, Nydegger & Seeley

(57) ABSTRACT

An x-ray tube having one or more components, such as the rotor, that include a coating of relatively high emissivity. The coating, a metal oxide composition for example, is selectively applied to desired portions of the component by plasma spray or similar process. The relatively high emissivity of the coating enhances the ability of the coated surface to radiate heat, and thereby aids in implementation of a cooling effect with respect to the x-ray tube.

33 Claims, 2 Drawing Sheets

HIGH EMISSIVE COATINGS ON X-RAY TUBE COMPONENTS

BACKGROUND OF THE INVENTION

1. The Field of the Invention

The present invention relates to x-ray tube devices. In particular, the present invention relates to x-ray tubes manufactured so as to reduce heat transmission to heat sensitive components, thus enhancing x-ray tube performance and longevity.

2. The Relevant Technology

X-ray producing devices are extremely valuable tools that are used in a wide variety of applications, both industrial and medical. For example, such equipment is commonly employed in areas such as medical diagnostic examination and therapeutic radiology; semiconductor manufacture and fabrication; and materials analysis.

Regardless of the applications in which they are employed, x-ray devices operate in similar fashion. X-rays are produced in such devices when electrons are emitted, accelerated, then impinged upon a material of a particular composition. This process typically takes place within an evacuated x-ray tube that contains a cathode, or electron source, and an anode oriented to receive electrons emitted by the cathode. The anode can be stationary within the tube, or can be in the form of a rotating annular disk supportably mounted to a spinning rotor shaft which, in turn, is supported by ball bearings contained in a bearing assembly. The rotating anode, rotor shaft, and bearing assembly are therefore interconnected and comprise a few of the primary components of the rotor assembly.

In operation, an electric current is supplied to a filament portion of the cathode, which causes a stream of electrons to be emitted by thermionic emission. A high voltage potential placed between the cathode and anode causes the electrons to form a stream and accelerate towards a target surface located on the anode. Upon approaching and striking the target surface, some of the resulting kinetic energy is released in the form of electromagnetic radiation of very high frequency, i.e., x-rays. The specific frequency of the x-rays produced depends in large part on the type of material used to form the anode target surface. Target surface materials with high atomic numbers ("Z numbers") are typically employed. The x-rays are then collimated so that they exit the x-ray tube through a window in the tube, and enter the x-ray subject, such as a medical patient.

As discussed above, some of the kinetic energy resulting from the collision with the target surface results in the production of x-rays. However, much of the kinetic energy is released in the form of heat. Still other electrons simply rebound from the target surface and strike other "non-target"0 surfaces within the x-ray tube. These are often referred to as "backscatter" electrons. These backscatter electrons retain a significant amount of kinetic energy after rebounding, and when they also impact other non-target surfaces they impart large amounts of heat.

Heat generated from these target and non-target electron interactions can reach extremely high temperatures and must be reliably and continuously removed. If left unchecked, it can ultimately damage the x-ray tube and shorten its operational life. Some x-ray tube components, like ball bearings housed in the bearing assembly, are especially sensitive to heat and are easily damaged. For instance, high temperatures can melt the thin metal lubricant that is typically present on the ball bearings, exposing them to excessive friction.

Additionally, repeated exposure to these high temperatures can degrade the bearings, thereby reducing their useful life as well as that of the x-ray tube.

These problems related to high temperatures produced in the x-ray tube have been addressed in a variety of ways. For example, rotating anodes are used to effectively distribute heat. The circular face of a rotating anode that is directly opposed to the cathode is called the anode target surface. The focal track comprising a high-Z material is formed on the target surface. During operation the anode and rotor shaft supporting the anode are spun at high speeds, thereby causing successive portions of the focal track to continuously rotate in and out of the electron beam emitted by the cathode. The heating caused by the impinging electrons is thus spread out over a larger area of the target surface and the underlying anode.

While the use of the rotating anode is effective in reducing the amount of heat present on the anode, high levels of heat are still typically present. Thus, cooling structures are often employed to further absorb and dissipate additional heat from the anode. Once absorbed the heat is typically conveyed to the evacuated tube housing surface, where it is then absorbed by a circulated coolant. One example of such an arrangement disposes concentric grooves on the surface of the anode inverse to the target surface. These anode grooves correspondingly receive concentric cooling fins typically formed on a portion of the evacuated tube. The cooling fins are situated in close proximity to the anode grooves such that during tube operation heat is transferred from the anode to the evacuated tube surface via the groove-fin juncture, then absorbed by the circulating coolant.

A related attempt to effectively dissipate heat in x-ray tubes has involved the utilization of more massive anode structures, enabling a given amount of conducted heat to be spread throughout a larger volume than that available in smaller anodes. Unfortunately, larger anodes require correspondingly more massive rotor assemblies to support the increased mass and rotational inertia of the anode. This in turn creates a larger conductive heat path from the anode, through the rotor shaft, and into the bearings in the rotor assembly, thus causing unwanted bearing heating.

The above cooling practices, while effective for general heat removal, can be insufficient by themselves to prevent heat from passing from the anode, through the rotor shaft, and into the bearings - especially in today's higher power x-ray tubes. As discussed before, this heat is highly detrimental to the bearings, and to other components within the x-ray tube.

Another method to control tube heat has been to provide x-ray tube components with coatings that exhibit improved thermal characteristics. For instance, coatings have been applied to various anode surfaces to enhance heat transfer from the anode.

The use of such coatings has not been completely successful however. For instance, over time the repeated cycles of heating and cooling may cause emissive coatings to flake or spall away from the coated surface. This debris can then contaminate other components within the x-ray tube, and lead to its premature failure. Moreover, there is often a thermal mismatch between the surface of the coated component and the emissive coating, which tends to weaken the bond between the two materials as they thermally expand during use. Again, this leads to undesired flaking and spalling and the consequent contamination of the x-ray tube.

Additionally, the previous placement of emissive coatings on tube components has not addressed the particular need of preventing heat transfer from the anode to the heat sensitive ball bearings housed in the bearing assembly.

What is needed, therefore, is an x-ray tube that withstands the destructive heat produced within it during use, thus protecting its components. Also desired is a method by which heat produced within the anode can be dissipated such that it is directed away from heat sensitive tube components. Also, any solution should avoid problems created by flaking, spalling, or thermal expansion.

SUMMARY AND OBJECTS OF THE INVENTION

It is therefore an overall object of the present claimed invention to provide an x-ray device and method that utilizes an emissive coating to provide improved thermal operating characteristics in the presence of extreme temperatures and temperature fluctuations.

A related objective is to provide an emissive coating that can be applied to areas within an x-ray tube where there exists a need to dissipate heat before it contacts less heat-tolerant tube components, such as rotor bearings.

Yet another objective is to provide an emissive coating that avoids flaking and spalling, and one that possesses thermal expansion properties that are compatible with other tube components.

It is an additional objective of the present invention to provide an emissive coating that will not produce outgassing or similar break down when subjected to the x-ray tube's high temperature vacuum environment.

These and other objects and features of the present claimed invention will become more fully apparent from the following description and appended claims, or may be learned by the practice of the invention as set forth hereinafter. Briefly summarized, the present invention utilizes a metal oxide formulation to form a high emissive coating that can be applied to the surfaces of certain x-ray tube components and thereby improve thermal operating characteristics. In one presently preferred embodiment a titanium oxide-aluminum oxide mixture is utilized as an emissive coating. Preferably, the emissive coating is then applied to the rotor shaft portion of an x-ray tube rotor assembly, using methods well known in the art, such as plasma techniques. The resulting rotor shaft exhibits several desirable characteristics, including a significant increase in its thermal emissivity. Given its location in close proximity to the tube's high temperature anode, the rotor shaft's enhanced emissivity due to the emissive coating allows excessive heat to be more efficiently radiated to adjacent cooling structures. This increased heat removal in turn equates to less heat damage being suffered by various heat sensitive tube components as well as a resultant increase in the tube's operational life.

Additional features of the preferred emissive coating include both an affinity for adherence to, and thermal compatibility with, the surface to be coated in order to prevent flaking and spalling. Presently preferred embodiments also exhibit good vacuum properties, which prevent outgassing or breakdown of the coating within the evacuated x-ray tube during use.

BRIEF DESCRIPTION OF THE DRAWINGS

In order that the manner in which the above recited and other advantages and features of the invention are obtained, a more particular description of the invention briefly described above will be rendered by reference to a specific embodiment thereof that is illustrated in the appended drawings. Understanding that these drawings depict only typical embodiments of the invention and are not therefore to be considered limiting of its scope, the invention will be described and explained with additional specificity and detail through the use of the accompanying drawings in which.

DETAILED DESCRIPTION OF THE PREFERRED EMBODIMENTS

Figure 1:
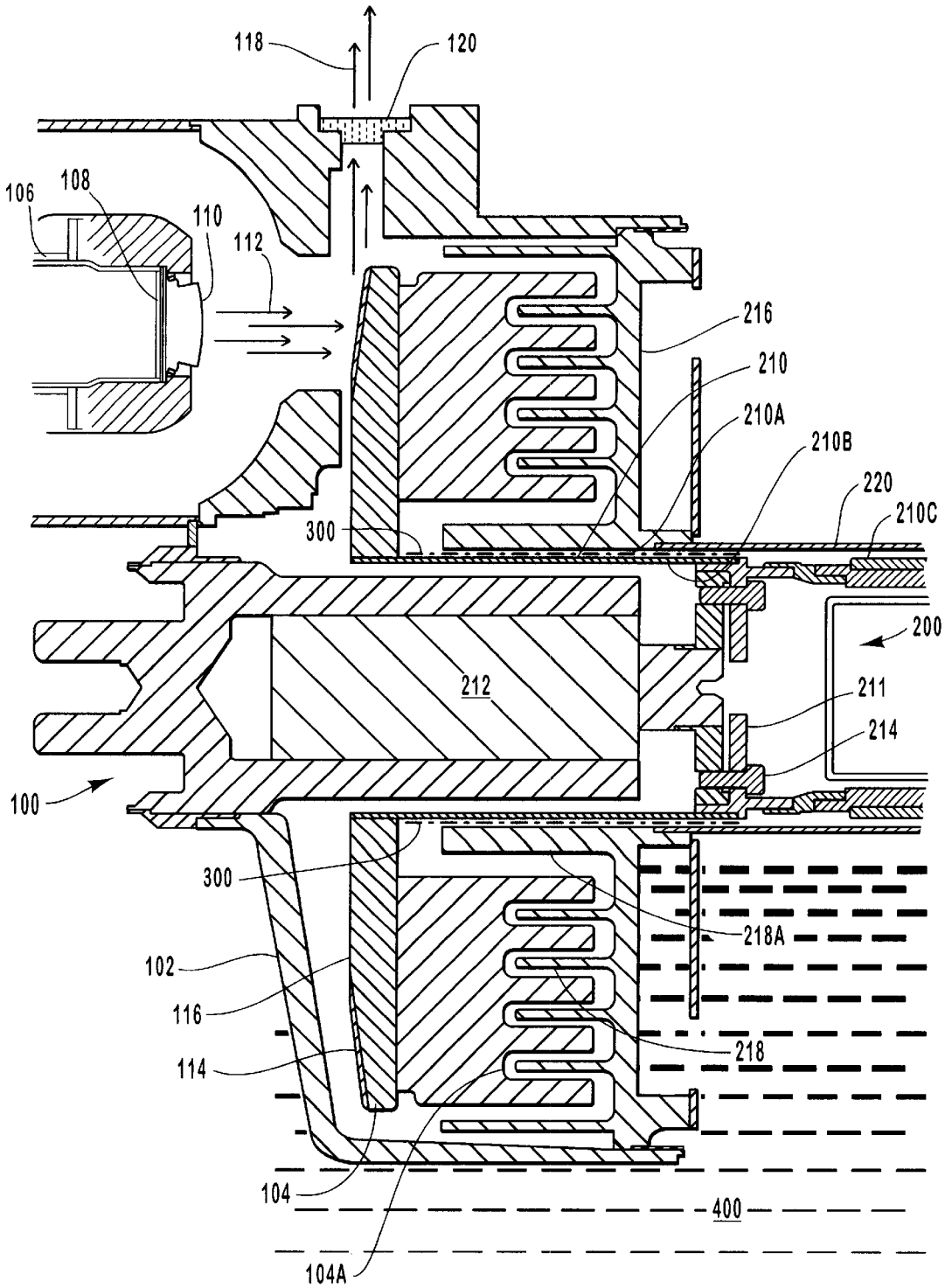
FIG. 1 is a cross sectional view of a rotating anode x-ray tube illustrating in cross section one presently preferred embodiment of the present claimed invention.
Figure 2:
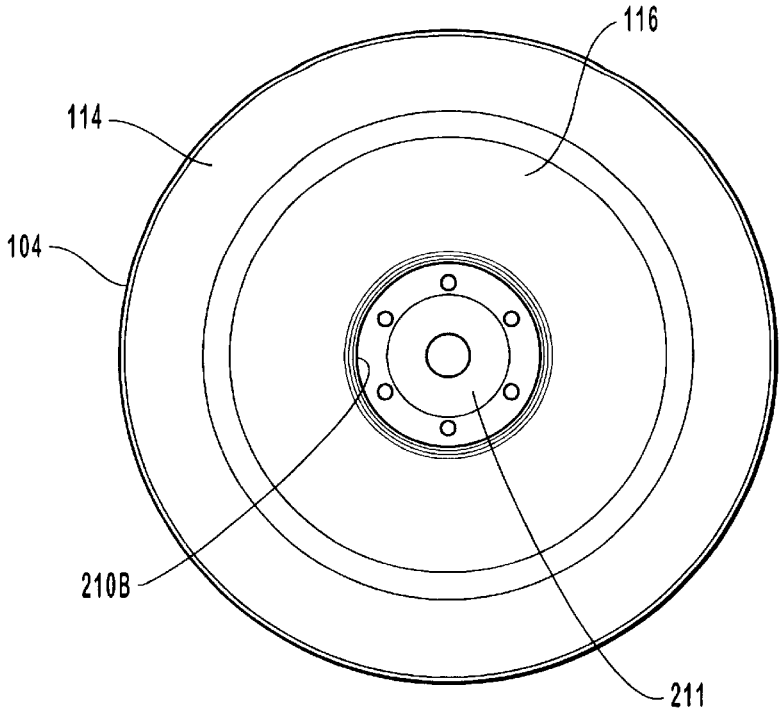
FIG. 2 is a plan view depicting the anode target surface and focal track of the anode in FIG. 1.
Figure 3:
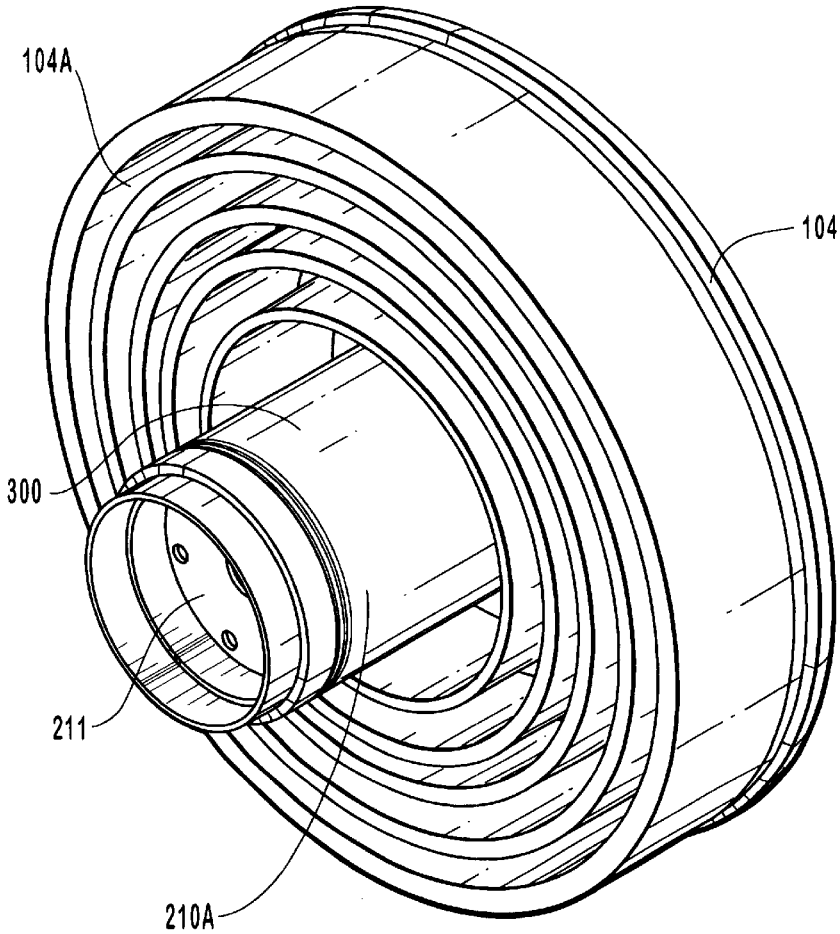
FIG. 3 is a perspective view of the anode portion and rotor shaft, depicting the arrangement of the anode grooves.

Reference will now be made to figures wherein like structures will provided with like reference designations. It is to be understood that the drawings are diagrammatic and schematic representations of presently preferred embodiments of the invention, and are not limiting of the present invention nor are they necessarily drawn to scale. In general, the present invention relates to an x-ray device having at least one structural component coated with a high emissive coating of particular composition such that the coating, in concert with cooling structures acting as heat sinks disposed in close proximity to the coating, increases the amount of heat radiated from the structural component. The emissive coating is preferably composed of a metal oxide and possesses characteristics that prevent it from degrading or spalling during use of the x-ray device. Use of the emissive coating is directed toward the goal of extending the operational lives of x-ray tubes and their components by equipping the coated tube components with superior heat management characteristics. FIGS. 1 through 3 together illustrate one presently preferred embodiment of such an emissive coating-enhanced x-ray tube.

Reference is first made to FIG. 1, which illustrates a simplified structure of a conventional rotating anode-type x-ray tube, designated generally at 100. X-ray tube 100 includes an evacuated housing 102 in which is disposed a rotating anode 104 and a cathode 106. A coolant 400 commonly envelops and circulates around evacuated housing 102 to assist in tube cooling. Anode 104 is spaced apart from and oppositely disposed to cathode 106. Anode 104 is typically composed of a thermally conductive material such as copper or a molybdenum alloy. Anode 104 may also comprise an additional portion composed of graphite and defining grooves 104A to assist in dissipating heat from the anode, as explained below in greater detail. As is well known, cathode 106 includes a cathode head 108 and filament 110 that is connected to an appropriate power source. The anode and cathode are connected within an electrical circuit that allows for the application of a high voltage potential between the anode (positive) and the cathode (negative). An electrical current passed through filament 110 causes a stream of electrons, designated at 112, to be emitted from cathode 106 by thermionic emission. The high voltage differential between the anode and cathode then causes electrons 112 to accelerate from cathode filament 110 toward a focal track 114 that is positioned on a target surface 116 of rotating anode 104, also depicted in FIG. 2. The focal track is typically composed of tungsten or a similar material having a high atomic ("high Z") number. As the electrons accelerate they gain a substantial amount of kinetic energy. Upon approaching and interacting with the target material on the focal track, some of the electrons convert their kinetic energy and either emit or cause to be emitted from the focal track material electromagnetic waves of very high frequency, i.e., x-rays. The resulting x-rays, designated at 118, emanate from the anode target surface and are then collimated through a window 120 for penetration into an object, such as an area of a patient's body. As is well known, the x-rays that pass through the object can be detected and analyzed so as to be used in any one of a number of applications, such as x-ray medical diagnostic examination or material analysis procedures.

With continuing reference to FIG. 1, additional detail is disclosed pertaining to rotating anode 104, its relation to rotor assembly of tube 100 (generally designated at 200), and various tube cooling components, including the presently preferred emissive coating. Rotating anode 104, additionally comprising focal track 114 and target surface 116, is operably connected to a rotor 210. Rotor 210 is preferably comprised of a heat conductive material such as copper or TZM (an alloy comprising a mixture of Molybdenum, Titanium, and Zirconium). In order to minimize its cross sectional area, the rotor 210 is preferably formed as a thin walled cylinder, thus limiting the amount of heat that can be conducted through it. For example, rotor 210 defines an outer surface 210A, an inner surface 210B, and an extended portion 210C. Rotor 210 has disposed within it bearing assembly 212, which houses a suitable bearing surface, such as a plurality of ball bearings disposed in a bearing track (not shown). Bearing assembly 212 is rotatably connected to a circular base plate 211 of rotor 210, said base plate 211 being fixedly disposed to inner surface 210B of rotor 210. Bearing assembly 212 is attached to circular base plate 211 preferably with fasteners 214, though it is appreciated that any suitable method of connecting the two components could be utilized. It will be appreciated that the illustrated rotor assembly is shown by way of example only; other rotor assemblies and configurations could also be used.

In a presently preferred embodiment, an emissive coating 300 is disposed on at least a portion of the outer surface 210A of rotor 210, although the coating could be applied to other areas as well. As will be explained in greater detail below, the emissive coating is applied in such a manner as to increase the radiation of heat from the surface to which it is applied, thereby improving the thermal characteristics of the x-ray tube.

FIG. 1 depicts one presently preferred arrangement of tube cooling structures in the form of a plurality of concentrically disposed cooling fins 218 formed on a thermal disk 216. The cooling fins 218 are cooperatively disposed with the concentric anode grooves 104A defined by a surface of the anode 104. These concentric anode grooves 104A are also illustrated in FIG. 3. In a preferred embodiment, at least one interior cooling fin 218A is interposed substantially between the inside diameter of the anode 104 and the outside diameter of the rotor 210. The thermal disk 216, in the illustrated embodiment is connected in thermal communication with a thermal sleeve 220 that is disposed in close proximity to and preferably concentrically extends about extended portion 210C of rotor 210.

Directing attention to the operation of x-ray tube 100, in a manner that is well known, the rotor shaft 210 and anode 104 are rotated about bearing assembly 212 by any suitable method, such as a stator motor (not shown). The stator motor is used to rotate anode 104 at high speeds (often in the range of 10,000 RPM), thereby causing successive portions of the focal track 114 to rotate into and out of the path of the stream of electrons 112. In this way, the stream of electrons emanating from cathode 106 is in contact with specific points along the focal track for only short periods of time, thereby allowing the remaining portion of the track to cool during the time that it takes the portion to rotate back into the path of the electron stream. The x-rays produced by this operation are collimated before exiting the tube and entering the x-ray subject.

As previously noted, x-ray production yields a significant amount of heat within the x-ray device that must be removed before it reaches tube components that may be damaged by it. One such component is bearing assembly 212 housing the ball bearings (or similar bearing surface). For example, in certain x-ray tube applications, the target surface 116 of anode 104 can easily reach temperatures between 1,000 and 1,300 degrees Celsius. However, typically the bearing assembly 212 must operate in a much lower temperature range, for example typically between 300 to 500 degrees Celsius. If this temperature range is exceeded, the lubricant protecting the bearings can fail, thus causing an increase in bearing friction. This in turn creates excessive bearing wear and ultimately leads to premature bearing failure. Optionally, the amount of heat conducted to the bearings is minimized.

To do so, typical x-ray tubes possess various structures and methods for cooling the device. One example of such a method is the circulation of a coolant 400 around the exterior of evacuated housing 102 as described above. Another example explained previously involves the use of cooling structures, such as anode grooves and cooling fins that absorb heat from the anode and other tube components and expel it to coolant 400. It is noted that coolants normally employed for such cooling include dielectric oils such as Shell Diala AX. Coolant 400 is continuously circulated to a heat exchanger device to remove heat transferred to it from the evacuated tube surface.

Notwithstanding the above cooling methods, however, a significant portion of heat created during tube operation is also directly conducted from anode 104 and its target surface 116 to rotor 210. In particular, rotor 210 serves as a direct conductive heat path from anode 104 to the bearing assembly 212. It is therefore highly desirable to remove as much heat as possible from rotor 210 before it reaches the bearing assembly 212.

As is represented in FIG. 1, this is accomplished in one embodiment by providing a high emissive coating 300 on at least a portion of the rotor 210. The emissive coating 300 operates to improve the emissive surface properties of the surface of the rotor 210. An increase in the emissivity of a surface yields an increase in the rate at which that surface radiates heat, where emissivity is simply a measure of how much heat is emitted from a substance by radiation. The emissive coating 300 thus minimizes the conduction of damaging heat through rotor 210 into bearing assembly 212, thus ensuring that the bearings continually operate within their specified temperature range, which in turn extends the operational life of the x-ray device.

Preferably, the emissive coating used possesses certain characteristics. First, it preferably provides a high emissivity characteristic. Second, the coating preferably possesses an affinity for the material to be adhered to, which in the preferred case is the outer surface of rotor 210. Similarly, the coating preferably possesses a similar coefficient of thermal expansion to that of the or substrate material. If the coating expands much more rapidly or slowly than the substrate, flaking and spalling of the coating may occur. Third, the emissive coating preferably exhibits good vacuum properties. This ensures that the coating material will not outgass (release gas products) or otherwise break down under the high vacuum, high temperature conditions that exist inside an x-ray tube during operation.

In a preferred embodiment, the emissive coating 300 is composed of a mixture of approximately 13% Titanium Oxide and 87% Aluminum Oxide. This mixture is known by the trade name OT13 and possesses an emissivity of approximately 0.75 or greater. To give meaning to the emissivity parameter of OT13, it is generally known that metals typically have emissivity values of between 0.2 and 0.3, where 1.0 generally represents a perfect emitter and 0.0 a non-emitter. For example, in a preferred embodiment rotor 210 is composed of TZM, the common trade name for an alloy comprising approximately 99% molybdenum and variable fractional percentages of Titanium and Zirconium. TZM typically possesses an emissivity of about 0.2. An OT13 emissive coating (emissivity 0.75), therefore, when applied to a TZM rotor, more than triples the emissivity of the shaft as compared to its uncoated state. Such an increase in emissivity of course translates to enhanced heat dissipation from the rotor surface, commensurately reducing the amount of heat conducted to the heat sensitive bearing assembly 212.

It will be appreciated by one of skill in the art that various other emissive coatings could be employed to achieve the functionality disclosed herein. For instance, an emissive coating comprising approximately 40% Titanium Oxide and 60% Aluminum Oxide possesses an emissivity of about 0.85 or higher. This coating is known by the trade name OT40, and is also an acceptable emissive coating. Accordingly, metal oxides and other materials possessing the required characteristics outlined above are understood to be within the claims of the present invention. Further, the emissive coating used will also be dictated by the type of substrate material being used.

OT13 as an emissive coating 300, also possesses acceptable affinity characteristics for adhering to a TZM rotor surface. Furthermore, OT13 has a coefficient of thermal expansion that is compatible with the TZM substrate material. This ensures that the two materials expand and contract during x-ray tube operation at roughly similar rates, thus preventing contamination problems associated with flaking and spalling. Again, it is appreciated that the affinity and thermal expansion qualities of emissive coating 300 translate into added operational vitality for x-ray tube 100.

A preferred embodiment of emissive coating 300, such as OT13, is so composed as to retain its compositional integrity while subjected to the high temperature, high vacuum operating tube environment. Therefore, little or no gases are emitted from emissive coating 300, thus preventing outgassing interference with tube operation. Additionally, emissive coating 300 is preferably composed such that the conduction of significant quantities of heat through it does not cause a breakdown in its emissive capacity over time.

Referring again to FIG. 1, one presently preferred location of emissive coating 300 is depicted. In the illustrated embodiment, the emissive coating 300 is applied to the outer surface 210A of rotor 210, along an area that preferably extends from the juncture of anode 104 with rotor 210 to a level defined on outer surface 210A. For example, the coating is preferably applied to a point adjacent to the juncture of base plate 211 with inner surface 210B.

While the above positioning of emissive coating 300 is a preferred embodiment, it is recognized that other areas may be identified for emissive coating application that require improved heat dissipation. For example, if bearing assembly 212 were to be disposed within an extended portion 210C of the rotor 210 adjacent to thermal sleeve 220, the emissive coating 300 would preferably be disposed on the outer surface of extended portion 210C, adjacent to such a placement of bearing assembly 212 as well. Accordingly, such other positional embodiments of emissive coating 300 would serve to dissipate heat from tube component surfaces that may otherwise flow to heat sensitive components. As such, these alternative embodiments are contemplated as being within the scope of the present claimed invention.

Emissive coating 300 is preferably applied to outer surface 210A by plasma spray coating, a procedure well known in the art. It will be appreciated, however, that various other procedures may be employed to provide proper application of the coating disclosed herein. Such alternative procedures include chemical vapor deposition, evaporation, and sputtering techniques, all of which are well known in the art.

In a presently preferred embodiment emissive coating 300 is applied to outer surface 210A such that its thickness falls within the range from ten (10) to fifty (50) microns. A coating thickness within this range ensures an adequate modification of the surface properties of outer surface 210A, which in turn advantageously increases its emissivity.

The features and advantages of embodiments of the present invention are made more apparent by continuing reference to FIG. 1. As noted, during tube operation a significant amount of heat is produced in the rotating anode 104, and a significant fraction of this heat is conducted along rotor shaft 210. The emissive coating 300 disposed on outer surface 210A of rotor 210 facilitates a significant radiation of the heat away from the rotor, thereby preventing it from reaching the heat-sensitive ball bearing region. To further facilitate the heat removal, interior cooling fin 218A is preferably disposed in close proximity to emissive coating 300 such that it absorbs a substantial amount of heat radiated from the emissive coating. This heat is conducted through interior cooling fin 218A to thermal disk 216 or a portion of evacuated housing 102, and then transferred to coolant 400.

It is noted here that the utilization of interior cooling fin 218A is but one example of a means for transferring heat emitted by emissive coating 300. It should be understood that this structure is presented solely by way of example and should not be construed as limiting the scope of the present claimed invention in any way.

In a preferred embodiment emissive coating 300 materially assists in heat radiation from the rotor shaft to a proximate cooling fin. Emissive coating 300 is therefore one example of a means for emitting a portion of heat from rotor 210. Accordingly, the structure disclosed herein simply represents one embodiment of structure capable of performing this function. It should be understood that this structure is presented solely by way of example and should not be construed as limiting the scope of the present claimed invention in any way. Moreover, it will be appreciated by one of skill in the art that the coating may be employed to radiate to various other structures or materials where such heat radiation is desirable. Examples of these would include radiation to other tube components, or radiation directly to the evacuated tube surface. Furthermore, it is appreciated that emissive coating 300 may be applied to inner surface 210B of rotor 210 as well as to its outer surface 210A, or to other surfaces of the rotor assembly. Accordingly, such arrangements are also contemplated as being within the scope of the present claimed invention.

Distinct benefits derive from the use of the present claimed invention as described above. Primary among them is a substantial reduction in the amount of heat that is transferred via a coated component to other attached components. In a preferred embodiment, a significant reduction in the amount of heat that is transferred through rotor 210 to the bearings inside bearing assembly 212 is attained. Correspondingly, a significant increase in the amount of heat that is radiated by the coated surface of rotor 210 is achieved, which heat is then absorbed by a suitable cooling structure. Consequently, the bearings are kept within an acceptable operating temperature range during tube use, thus extending their operational life as well as that of the tube itself.

Additionally, use of emissive coating 300 allows for rotor 210 to be constructed with a thicker wall portion while at the same time inhibiting heat transfer to bearing assembly 212 at the same rate that an uncoated rotor shaft with thinner walls would be able to achieve. Such an increase in rotor shaft thickness and strength enables larger anodes to be attached to the rotor shaft, which in turn enhances the anode's heat dissipating ability, further enabling the tube to run cooler.

The present claimed invention may be embodied in other specific forms without departing from its spirit or essential characteristics. The described embodiments are to be considered in all respects only as illustrative, not restrictive. The scope of the invention is, therefore, indicated by the appended claims rather than by the foregoing description. All changes that come within the meaning and range of equivalency of the claims are to be embraced within their scope.

What is claimed and desired to be secured by United States Letters Patent is:

1. An x-ray tube comprising:

a vacuum enclosure having an electron source and anode disposed therein, said anode having a target surface positioned to receive electrons emitted by said electron source;

a rotor at least partially received within said anode, and wherein the rotor is operably connected to the anode;

a bearing assembly rotatably supporting said rotor and at least partially received within said anode so that said rotor is at least partially interposed between said bearing assembly and said anode; and an emissive coating disposed on at least a portion of said rotor that is disposed within the anode, the coating being comprised of a material that increases the emissivity of the rotor surface.

2. An x-ray tube as defined in claim 1, further comprising at least one cooling structure disposed proximate said emissive coating wherein heat emitted from said emissive coating is at least partially absorbed by said at least one cooling structure.

3. An x-ray tube as defined in claim 2, wherein said at least one cooling structure comprises an annular extended surface concentrically disposed about said rotor.

4. An x-ray tube as defined in claim 1, wherein said emissive coating is composed of a metal oxide.

5. An x-ray tube as defined in claim 1, wherein said emissive coating possesses an emissivity of 0.65 or greater.

6. An x-ray tube as defined in claim 1, wherein said emissive coating comprises a mixture of titanium oxide and aluminum oxide.

7. An x-ray tube as defined in claim 6, wherein said mixture comprises approximately 13% titanium oxide and approximately 87% aluminum oxide.

8. An x-ray tube as defined in claim 6, wherein said mixture comprises approximately 40% titanium oxide and approximately 60% aluminum oxide.

9. An x-ray tube as defined in claim 6, wherein said mixture comprises approximately 3% titanium oxide and approximately 97% aluminum oxide.

10. An x-ray tube as defined in claim 1, wherein said emissive coating is formed to a thickness of at least 10 microns.

11. The x-ray tube as recited in claim 1, wherein said rotor is substantially in the form of a hollow cylinder.

12. The x-ray tube as recited in claim 1, wherein said rotor comprises an inner surface proximate said bearing assembly and an outer surface proximate said anode, said emissive coating being disposed at least on said outer surface.

13. The x-ray tube as recited in claim 1, wherein said emissive coating is applied to at least one other surface defined by the x-ray tube.

14. A rotor assembly suitable for use in conjunction with a device having a rotatable component wherein a bearing assembly is at least partially received, the rotor assembly comprising:

a rotor at least partially received within the rotatable component so that said rotor is interposed between the rotatable component and the bearing assembly, said rotor being rotatably supported by the bearing assembly; and an emissive coating disposed on a portion of said rotor.

15. The rotor assembly as recited in claim 14, wherein said rotor comprises an inner surface proximate the bearing assembly and an outer surface proximate the rotatable component, said emissive coating being disposed at least on said outer surface.

16. The rotor assembly as recited in claim 14, wherein said emissive coating is applied to at least one other surface defined by the device.

17. The rotor assembly as recited in claim 14, wherein said emissive coating substantially comprises at least one metal oxide.

18. The rotor assembly as recited in claim 17, wherein said at least one metal oxide comprises titanium oxide.

19. The rotor assembly as recited in claim 17, wherein said at least one metal oxide comprises aluminum oxide.

20. The rotor assembly as recited in claim 17, wherein said at least one metal oxide comprises a mixture of aluminum oxide and titanium oxide.

21. A heat dissipation system suitable for use in conjunction with an x-ray tube having a vacuum enclosure containing an electron source and an anode having a target surface positioned to receive electrons emitted by the electron source, the anode at least partially receiving a rotor and being connected thereto, the x-ray tube further including a bearing assembly rotatably supporting the rotor and at least partially received within the anode so that the rotor is interposed between the bearing assembly and the anode, the heat dissipation system comprising;

an emissive coating disposed on a portion of the rotor; and a cooling structure disposed proximate said emissive coating.

22. The heat dissipation system as recited in claim 21, wherein said emissive coating substantially comprises at least one metal oxide.

23. The heat dissipation system as recited in claim 21, wherein said cooling structure comprises a plurality of extended surfaces.

24. The heat dissipation system as recited in claim 21, wherein said cooling structure is substantially concentric with the rotor and bearing assembly.

25. The heat dissipation system as recited in claim 21, wherein said emissive coating is applied to at least one other surface defined by the x-ray tube.

26. The heat dissipation system as recited in claim 21, further comprising a liquid coolant in contact with said cooling structure.

27. An x-ray tube comprising:

a vacuum enclosure having an electron source and anode disposed therein, said anode having a target surface positioned to receive electrons emitted by said electron source;

a rotor at least partially received within said anode and connected thereto;

a bearing assembly rotatably supporting said rotor and at least partially received within said anode so that said rotor is interposed between said bearing assembly and said anode; and means for emitting heat from said rotor.

28. The x-ray tube as recited in claim 27, wherein said means for emitting heat from said rotor prevents at least some heat present in said anode from being transmitted to said bearing assembly.

29. The x-ray tube as recited in claim 27, wherein said means for emitting heat from said rotor directs at least some of the heat transmitted by said anode into a predetermined component of the x-ray tube.

30. The x-ray tube as recited in claim 27, further comprising a cooling structure.

31. The x-ray tube as recited in claim 30, wherein said means for emitting heat from said rotor directs at least some of the heat transmitted by said anode away from said bearing assembly and into said cooling structure.

32. The x-ray tube as recited in claim 27, wherein said means for emitting heat from said rotor contributes to a relative reduction in bearing assembly operating temperature.

33. The x-ray tube as recited in claim 27, wherein said means for emitting heat from said rotor comprises an emissive coating applied to at least a portion of a surface of said rotor.

* * * * *